United States Patent [19]

Coates

[11] Patent Number: 4,705,475

[45] Date of Patent: Nov. 10, 1987

[54] INSULATED REFRACTORY SHIELD

[75] Inventor: Stephen J. Coates, Galena, Ill.

[73] Assignee: Merkle Engineers, Inc., Galena, Ill.

[21] Appl. No.: 856,039

[22] Filed: Apr. 25, 1986

[51] Int. Cl.[4] ..... F27D 1/12; F23M 5/00

[52] U.S. Cl. ..... 432/238; 432/248; 432/249; 110/336

[58] Field of Search ..... 432/237, 238, 247–249; 110/336, 349

[56] References Cited

U.S. PATENT DOCUMENTS

| | | | |
|---|---|---|---|
| 1,605,885 | 11/1926 | Willetts | 432/248 |
| 3,045,994 | 7/1962 | Longenecker | 110/336 |
| 3,139,846 | 7/1964 | Longenecker . | |
| 3,812,798 | 5/1974 | Merkle, Jr. | 432/238 |
| 4,157,001 | 6/1979 | Pickles | 110/336 |
| 4,283,172 | 8/1981 | Syvakani | 432/249 |
| 4,325,694 | 4/1982 | Bergman | 432/249 |
| 4,332,552 | 6/1982 | Seelandt | 110/336 |
| 4,453,475 | 6/1984 | Ploger | 110/336 |
| 4,582,742 | 4/1986 | Gilhart | 432/247 |

*Primary Examiner*—Henry C. Yuen

*Attorney, Agent, or Firm*—Thomas W. Speckman; Ann W. Speckman

[57] ABSTRACT

An insulated refractory shield is provided to reduce heat loss through the exterior surface of the refractory shield while at the same time a cooling fluid is directed over the cast metallic refractory supports and hanger means through apertures in the hanger tube. Modular insulation units are provided and are retained between the exterior face of the refractory bricks and the hanger tube by means of specialized wedges and support clips.

13 Claims, 9 Drawing Figures

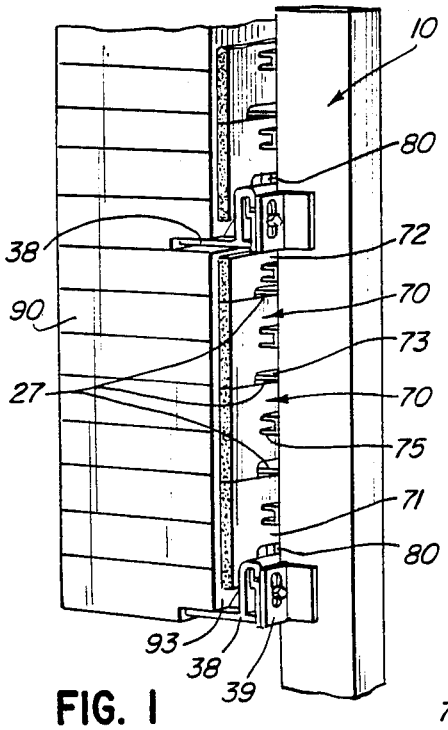
FIG. 1
FIG. 2
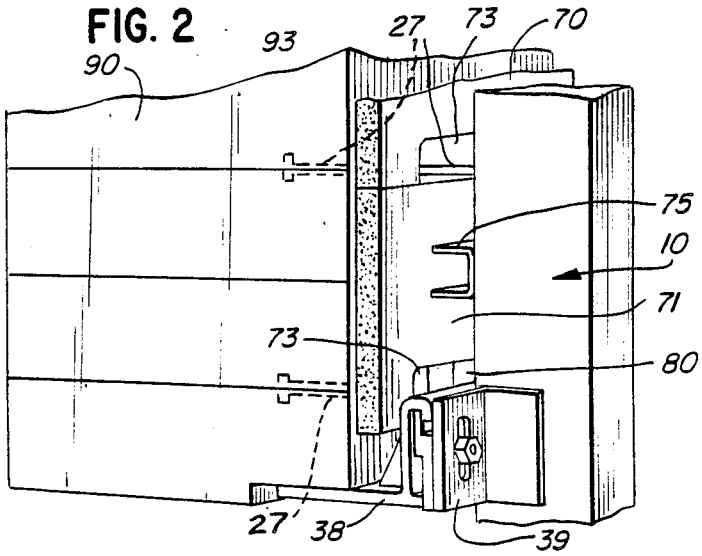
FIG. 3a
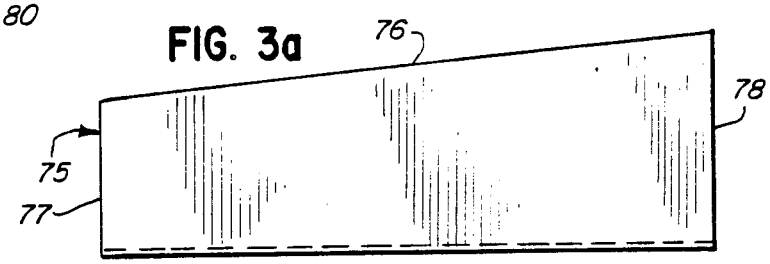
FIG. 3c
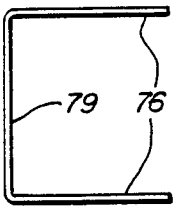
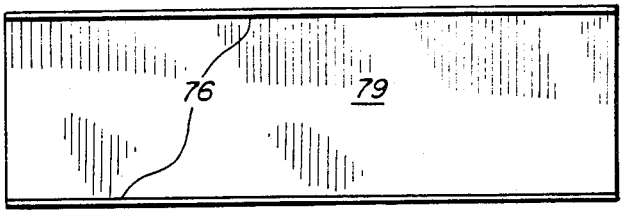
FIG. 3b
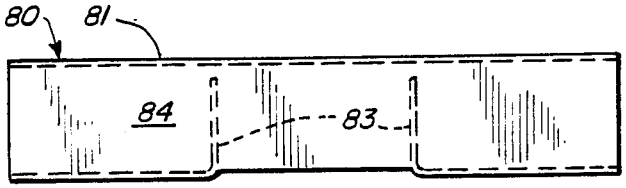
FIG. 4b
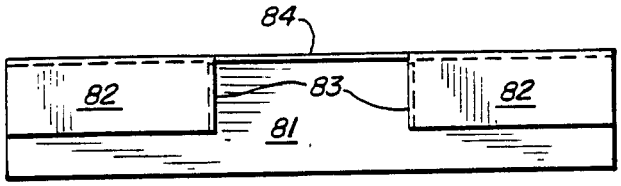
FIG. 4d
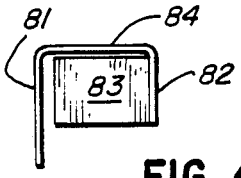
FIG. 4c
FIG. 5
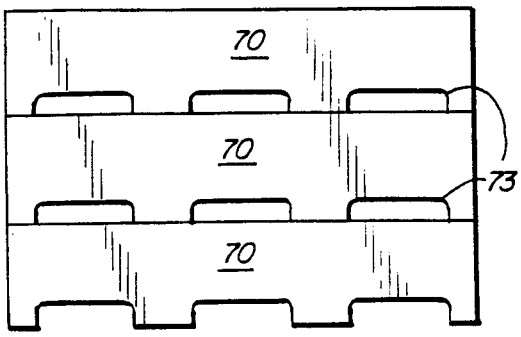

INSULATED REFRACTORY SHIELD

BACKGROUND OF THE INVENTION

1. Field of the Invention

This invention relates to improvements in insulation for a refractory shield in high temperature industrial furnaces. More particularly, this invention relates to insulated suspended furnace walls in which metallic hangers for mounting a refractory shield are effectively cooled by exposure to a cooling fluid, while the exterior face of the refractory shield is effectively insulated to reduce energy requirements for high temperature industrial furnaces.

2. Description of the Prior Art

High temperature industrial furnaces are typically lined with a refractory material. Occasionally a flat roof is required, or relatively long open slots must be provided in the furnace walls for feeding a charge into the furnace. In such cases, it is necessary to suspend and tie back the refractory material to a structural framework. In high temperature furnaces, such as glass manufacturing furnaces, it is desirable to direct a cooling fluid over the metallic suspension or tie-back means to reduce the average temperature of the suspension or tie-back means and thereby prolong their service life. Suspension and tie-back means typically comprise cast metallic pieces which may deteriorate and crack when subjected to extended exposure at high temperatures.

The desirability of cooling the exterior side of the refractory wall and the metallic hangers has been recognized by prior art. U.S. Pat. No. 3,045,994 suggests cooling the furnace wall, i.e., the refractory shield, as well as the metallic hangers therefor by passing an airstream upwardly along the furnace wall and providing lateral apertures in the hanger castings to facilitate the air flow. This approach, while providing some cooling of the metallic hangers, is unsatisfactory since the airstream is warmed by prior contact with the lower portion of the furnace wall, and because the airstream moves at a relatively slow rate. U.S. Pat. No. 3,139,486 teaches that direct impingement of a concentrated cooling air blast onto a refractory furnace wall is undesirable, since such impingement causes holes and/or cracks to develop in the furnace wall.

U.S. Pat. No. 3,812,798, the teachings of which are incorporated by reference herein, teaches a mounting means for a suspended refractory shield which comprises a support means providing structural support for the refractory shield; a hollow, tubular hanger tube depending from the support means; a plurality of substantially Y-shaped metallic hanger means and/or shelf hanger means engaging the hanger tube and adapted to engage and hold refractories forming the refractory shield; and a cooling fluid supply means communicating with an open end of the hanger tube and providing cooling fluid through oblong openings in the hanger tube directly cooling the metallic hanger means mounted on the hanger tube. This suspended wall design has proven very successful, and the present invention relates to improvements thereto.

SUMMARY OF THE INVENTION

It is an object of the present invention to provide an insulated refractory shield such as a furnace wall or roof in high temperature industrial furnaces whereby metallic hangers and support means are effectively cooled by exposure to a cooling fluid, while at the same time, the exterior surface of the refractory shield is insulated to reduce energy requirements for the furnace.

It is another object of the present invention to provide insulated suspended walls for use in high temperature industrial furnaces which reduce thermal energy losses, yet provide safe mean operating temperatures for the refractory materials and metallic tie-back and support means.

It is yet another object of the present invention to provide a design for insulating suspended walls which may be adapted to insulate existing refractory shields in high temperature industrial furnaces without requiring disassembly of the suspended walls and prolonged service interruptions.

Increasing energy costs and the growing importance of energy conservation necessitates re-examination of existing high temperature industrial furnace and refractory shield designs. Provision of insulation is a preferred expedient to reduce heat loss at the exterior surface of a refractory shield. Some cooling of the metallic hangers is, however, necessary to prevent deterioration of the hanger supports and to ensure safe operation of the furnace.

According to the present invention, insulation is provided to reduce heat loss through the exterior surface of the refractory shield, while at the same time a cooling fluid is directed over the cast metallic refractory supports and hanger means through apertures in the hanger tube. The mounting means for a refractory shield, including the hanger tube and refractory support structures, and the means for providing a cooling fluid supply directly to the cast metallic refractory supports taught by U.S. Pat. No. 3,812,798 is preferred for use in the present invention. However, the insulated refractory shield of this invention may be used with other designs for metallic refractory support structures and metallic cooling systems.

Providing insulation to the "cold" exterior refractory surface of a high temperature refractory shield will, of course, reduce thermal losses through the exterior refractory surface and raise the mean temperature of the refractories comprising the refractory shield and of the metallic refractory supports. A balance must be struck between effectively insulating the furnace to reduce energy requirements and, therefore, operating costs, while still maintaining a safe operating temperature range for the refractory materials and metallic support structures. Since the provision of insulation does result in a higher refractory mean operating temperature, it is important that cooling fluid is supplied directly over the cast metallic refractory support structures, and that the insulation not interfere with the supply and delivery of cooling fluid. Furthermore, it is desired to provide such insulation in a convenient form whereby existing suspended refractory walls may be insulated without requiring disassembly of the refractory shield or a significant interruption of furnace operations.

The preferred insulating material of the present invention comprises ceramic fiberboard which is rigid and relatively lightweight to provide easy handling and installation. The insulation is preferably precut to conform to spacing of the hanger tubes and metallic refractory supports, but it may also be easily modified, such as by cutting, for specialized installation requirements. A rigid material is desirable from the standpoint that it closely interfaces and contacts the exterior surface of the suspended refractory wall to provide a constant, uniform insulating effect and to prevent local temperature differentials from developing along the suspended refractory wall.

The present invention provides a modular insulating system comprising individual, precut insulating units which are arranged to interface with the exterior face of the refractory wall and are supported between the refractory wall and the structural hanger tube. The insulating units are precut to accommodate both shelf and tie-back hangers and to provide passage of cooling fluid over the shelf and tie-back hangers. Insulation units are provided with an elongated cutout which is slightly larger than the dimensions of the tie-back hangers and oblong apertures in the hanger tube to provide flow of cooling fluid directly over the shelf and tie-back hangers, without significantly reducing the effectiveness of the insulation.

The desired thickness of the preferred ceramic fiberboard insulation units depends upon the application and the safe operating temperature ranges of the suspended refractory wall, particularly the refractory materials and the metallic refractory supports, such as shelf and tie-back hangers. For most applications, based upon temperature gradient studies, the preferred ceramic fiberboard insulation thickness is from about ½ inch to about 2 inches and preferably, about 1 inch. Insulation of this thickness is conveniently accommodated between the refractories and the hanger tube and may be installed directly on the exterior face of the refractory wall and retained thereon by means of special bent sheet metal or roll formed wedges driven between the exterior face of the insulation and the interior face of the hanger tube which supports the shelf and tie-back hangers and provides direct flow of cooling fluid through the elongated cutouts onto the metallic hangers. A specially designed bent sheet metal or roll formed support clip is provided to support the first course insulation unit installed above each shelf hanger and to prevent the first course insulation unit from interfering with direct flow of cooling fluid over the tie-back hanger immediately above the shelf hanger. The wedges and retaining clips preferably comprise a low carbon steel material.

The higher refractory mean operating temperatures which result from the provision of insulation having a thickness of from about ½ inch to 2 inches on the exterior face of the refractory wall remain at safe levels for most conventionally used refractory wall materials, such as silica and/or bonded AZS (alumina-zirconia-silica) or fused-cast AZS material backed with mullite. Increases in the refractory mean operating temperatures resulting from the provision of insulation may, however, equal or exceed safe operating temperature ranges for cast metallic shelf and tie-back hangers, and alternative materials may be required. For example, cast metallic shelf and tie-back hangers conventionally comprise Meehanite cast iron. Empirical temperature studies performed on insulated suspended refractory walls demonstrated that the safe mean operating temperature for Meehanite castings would likely be exceeded, and that Meehanite castings should be replaced with castings having a higher safe operating temperature range, such as a 25/20 (nickel-chrome) alloy, or other similar temperature resistant alloy. Replacement of the Meehanite support castings with 25/20 alloy material involves only a modest cost increase, but significantly reduces the risk of failure at higher furnace operating temperatures and provides a greater margin of safety.

An insulated suspended refractory wall contributes significantly to improved furnace efficiency, and heat loss through the furnace walls insulated according to this invention may be reduced by nearly half, as compared to uninsulated suspended refractory walls. The insulated suspended refractory wall according to the present invention accommodates delivery of cooling fluid directly over metallic shelf and tie-back hangers which is important to the success of the insulation design.

BRIEF DESCRIPTION OF THE DRAWINGS

The above objects and other advantages of the invention will become apparent upon reading the following description of preferred embodiments with reference to the drawings, wherein:

FIG. 1 shows a perspective view of an insulated suspended refractory shield according to one embodiment of the present invention;

FIG. 2 shows an enlarged perspective view of the insulated refractory shield of FIG. 1;

FIG. 3*a* shows a top view of a sheet metal wedge according the present invention;

FIG. 3*b* shows a side view of the wedge shown in FIG. 3*a;*

FIG. 3*c* shows an end view of the wedge shown in FIG. 3*a;*

FIG. 4*a* shows a side view of a sheet metal support clip according to the present invention;

FIG. 4*b* shows a top view of the support clip shown in FIG. 4*a;*

FIG. 4*c* shows an end view of the support clip shown in FIG. 4*a;* and

FIG. 5 shows a front view of insulation units adapted to insulate a refractory shield according to the present invention.

DESCRIPTION OF PREFERRED EMBODIMENTS

Referring to FIG. 1, hanger tube 10 comprises a hollow metallic tube having a generally rectangular cross section. As shown in FIG. 1 of U.S. Pat. No. 3,812,798, mounting lugs 11 and 12 are attached to each side wall of hanger tube 10 and secure hanger tube 10 to a suitable external support means, such as support beam 13 so that hanger tube 10 hangs freely therefrom by engaging stop block 14 welded onto support beam 13. Open end 15 of hanger tube 10 is adapted for communication with suitable cooling fluid supply means. Interior longitudinal face 16 of hanger tube 10 is provided with a plurality of oblong apertures 17–25 for mounting refractory supports and for directing cooling fluid flowing through hanger tube 10 directly onto refractory supports, such as tie-back hangers 27 and shelves 37 and 38 to aid in distributing the weight of the refractory bricks 30 supported by tie-back hangers 27. Shelf hangers 38 shown in FIGS. 1 and 2 are mounted to hanger tube 10 by means of mounting lugs 39. Oblong apertures 17–25 are provided at intervals along hanger tube 10 as necessary to accommodate and support tie-back hangers 27. Lower end 26 of hanger tube 10 is preferably closed to increase the flow of cooling fluid through apertures 17 to 25. Portions of the hanger tube may also be curved, as is known in the art, to support a furnace wall or an arcuate roof portion. Shelf hangers 37 and 38 are cooled by cooling fluid flowing through apertures 17–25 directly above them. If hanger tube 10 is situated in a generally horizontal position, for example as in flat suspended refractory roof construction, shelf hangers 37 or 38 need not be used. Tie-back hangers 27 and shelf hangers 37 and 38 when used in an insulated structure of this invention may be required to withstand higher temperatures than conventionally used Meehanite cast iron. Materials having similar strength and higher heat-withstanding characteristics, such as a 25/20 (nickel-chrome) alloy and other similar temperature resistant alloys are preferred. Suitable materials are known to the art. Numerals used in FIGS. 1 and 2 of this application are the same as those used in U.S. Pat. No. 3,812,798 for the same structure.

Insulation units 70, 71 and 72 according to the present invention interface exterior face 93 of refractories 90 comprising the refractory shield and are held in place contacting exterior face 93 by means of wedges 75 installed between each insulation unit 70, 71 and 72 and interior face 16 of hanger tube 10. Standard insulation units 70, 71 are sized for installation between adjacent tie-back hangers 27, while upper course insulation unit 72 is sized for installation directly below a shelf hanger 38. Insulation units 70, 71 and 72 each comprise flat ceramic fiberboard insulation with cutouts 73 provided therein. Cutouts 73 are dimensioned to accommodate tie-back hangers 27 and apertures 17–25 in hanger tube 10 to provide direct flow of cooling fluid onto tie-back hangers 27 and are spaced in accordance with the spacing of hanger tubes 10. First course insulation unit 71, as best seen in FIG. 2, is supported above tie-back hanger 27 by retaining clip 80 to space the top of cutout 73 of first course insulation unit 71 above tie-back hanger 27 to provide free flow of cooling fluid over tie-back hanger 27 and shelf hanger 38. Insulation units 70 and upper course insulation units 72 each rest upon the next lower course insulation units and free flow of cooling fluid over tie-back hanger 27 is effected by the tie-back hangers being centrally spaced in insulation cutouts 73.

Upper course insulation unit 72 is shortened in height for installation below a shelf hanger 38 as best seen in FIG. 1. Upper course insulation unit 72 is approximately one-half the vertical height of standard insulation unit 70. When shelf hangers are not required to support a refractory shield, upper course insulation units 72 are not necessary and standard insulation units 70 are used throughout. Insulation units 70, 71 and 72 may be provided in a standard width corresponding to the spacing of multiple hanger tubes 10, suitable widths corresponding to three to six hanger tubes.

Insulation units 70, 71 and 72 preferably comprise a rigid ceramic fiberboard material. One preferred material is Manville Cera-Form Board Type 103 having the following composition: 39.6 percent alumina ($Al_2O_3$); 50.7 percent silica ($SiO_2$); 0.32 percent ferric oxide ($Fe_2O_3$); 0.13 percent magnesia (MgO); and 0.2 percent alkalies, and having a density of 13.5 lb/ft$^3$. This ceramic fiberboard insulation is available from Manville Corp., Ken Caryl Ranch, Denver, Colo. 80217. Other ceramic fiberboard insulating materials having similar compositions and densities are also suitable. Insulation units 70, 71 and 72 are preferably of a thickness of about ½ inch to about 2 inches. In an especially preferred embodiment, insulation units are about 1 inch thick.

Specially designed wedge 75, shown in top view in FIG. 3*a*, is of tapering channel shape having a narrow end 77 and wide end 78 with a flat side wall 79 joining parallel extending legs 76. The end of extending legs 76 forms the wedge shape and when installed, as best seen in FIGS. 1 and 2, may cut into the insulation board and aid in retaining it in position while flat side wall 79 is adjacent hanger tube 10. The wedging action holds the insulation board firmly against exterior face 93 of refractories 90. Wedge 75 is suitably made of preferably 20 to 24 gauge galvanized sheet steel, preferably low carbon. A suitable size wedge for most installations is about 4 inches long, 1¼ inch high and 1 inch deep at the narrow end and 1⅜ inch at the wide end of the wedge. Use of wedges 75 is ordinarily not necessary when 2 inch thickness insulation units are provided since insulation units of this thickness typically abut both exterior face 93 of refractories 90 and interior face 16 of hanger tube 10, and are firmly retained therebetween.

Specially designed support clip 80 is shown in FIG. 4*a* in side view showing inner side 81 extending below outer side 82. Outer side 82 is cut in its central portion and flaps 83 are bent back toward inner side 81 providing support for upper side 84. The first course of insulation units 71 above shelf hanger 38 is supported above the tie-back metallic used in conjunction with the shelf metallic to allow free flow of cooling fluid over that tie-back metallic and the shelf metallic. The top edge of cutout 73 of insulation unit 71 rests on support clip upper side 84. Support clip inner side 81 is adjacent exterior face 93 of furnace refractory 90 and support clip 80 is sized to enable the lower edge of outer side 82 to rest on the top of tie-back hanger metallics, the extending legs of the tie-back hangers extending between refractory bricks 90 and passing beyond the ends of support clip 80. Support clip 80 preferably comprises 20 to 24 gauge galvanized sheet steel, preferably low carbon. A suitable size support clip for many installations is 4 inches long, ¾ inch deep, with an inner side ¾ inch high and outer side ½ inch high.

Specially designed wedge and insulation support clip may be appropriately sized for the distance between the interior face of hanger tube 10 and the exterior face of the insulation units and for the size and shape of the tie-back metallics used, respectively.

The following example is set forth in detail to illustrate preferred embodiments of this invention and should not be considered to limit the invention in any manner.

EXAMPLE 1

Experiments were conducted to determine, empirically, the effect of insulating the exterior face of refractories comprising a suspended refractory shield. Temperature gradients were measured to determine changes in mean operating temperatures of the refractories which resulted from the provision of various thicknesses of insulation. Ceramic fiberboard insulation units with cutouts were installed on the exterior face of the refractory shield as described in the above disclosure. Refractories comprised 3 inches fused cast AZS backed with 12 inches of mullite having a safe use temperature limit of 2500° F. The hot face temperature of the furnace was 2800° F. Results of the temperature gradient studies are shown in Table 1.

TABLE 1

| | mean temp/ mullite | BTU loss per sq. ft/hr. |
|---|---|---|
| Uninsulated refractory shield | 1525° F. | 2350 |
| 1" insulation | 2225° F. | 1080 |
| 2" insulation | 2400° F. | 800 |

TABLE 1-continued

| | mean temp/ mullite | BTU loss per sq. ft/hr. |
|---|---|---|
| 3" insulation | 2470° F. | 640 |

This study demonstrates that 1 inch thickness ceramic fiberboard insulation does provide substantial energy savings and that 2 inch and 3 inch insulation thicknesses do not provide proportionately greater insulating effects or energy savings. Use of a two inch insulation thickness does, however, provide substantial energy savings without jeopardizing the refractories or the metallic supports. Use of a 3 inch insulation thickness would not be recommended since it increases operating temperatures to the extent that safe use temperature limits of the refractories and support materials are approached. Use of a 1 inch insulation thickness is preferred, since it provides the greatest proportional insulating effect and energy savings without endangering the refractories and support castings. Comparing properties, availability and cost of several different casting alloys, however, a 25/20 alloy was chosen for hanger support structures since it can safely withstand higher operating temperatures than conventionally used Meehanite cast iron and it entails only a modest cost increase.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

I claim:

1. In a refractory shield for a high temperature furnace comprising: a hollow hanger tube depending from a support beam and having one flat face with a plurality of longitudinally arranged oblong openings spaced to receive one end of metallic hanger means having an opposite end to engage and hold refractory brick forming a part of said refractory shield wherein at least one shelf metallic hanger means is spaced between a plurality Y-shaped tie-back metallic hanger means, said opposite end of said tie-back metallic hanger means having extending legs engaging and holding said refractory bricks, said oblong openings receiving said hanger means having a cross-sectional area greater than the cross-sectional area of said metallic hanger means passing therethrough to allow cooling fluid introduced at one end of said hollow hanger tube and flowing the length to said tube to pass outwardly at said oblong openings cooling said metallic hanger means, the improvement comprising: a plurality of rigid insulation units between said refractory shield and said hanger tube contacting the exterior surface of said refractory brick, each said insulation unit having a height of two courses of said refractory bricks and having oblong cutouts along a bottom edge to accommodate said metallic hanger means and allowing said cooling fluid to flow from said hollow hanger tube oblong openings over said metallic hanger means; a plurality of generally channel-shaped wedges having extending legs joined by a flat side wall, at least one said wedge between an exterior face of each said insulation unit and said flat face of said hollow hanger tube, said extending legs against said insulation unit and said flat side wall against said flat face of said hollow hanger tube forcing an interior face of said insulation unit into said contact with said exterior surface of said refractory brick; and a support clip positioned between said extending legs of a first said tie-back metallic hanger means immediately above said shelf metallic hanger means, said support clip having a flat upper side for supporting the top of said oblong cutout of said insulation units by resting thereon, and having an inner side resting adjacent the exterior face of said refractory brick and a shorter outer side cut in its central portion to form flaps which are bent inwardly to provide support for said upper side, the lower edges of the end regions of said outer side resting on the upper surface of said tie-back metallic hanger means providing support for the first course of each insulation unit above each said shelf metallic hanger means and providing an opening for flow of cooling fluid from said hollow tube over said shelf metallic hanger means and said first tie-back metallic hanger means immediately thereabove.

2. An insulated refractory shield according to claim 1 wherein said ceramic firberboard material has a density of about 12 to about 15 lb/ft$^3$.

3. An insulated refractory shield according to claim 1 wherein said metallic hanger means comprise a 25/20 alloy.

4. An insulated refractory shield according to claim 1, wherein said refractory bricks are selected from the group consisting of: silica, bonded AZS, fused-cast AZS, mullite, and combinations thereof.

5. An insulated refractory shield according to claim 1 wherein said wedges comprise a low carbon steel material.

6. An insulated refractory shield acording to claim 1 wherein said insulation units are provided in a width corresponding to the spacing of multiply hanger tubes with said insulation cutouts corresponding to said oblong openings in said multiple hanger tubes.

7. An insulated refractory shield according to claim 6 wherein said insulation units are provided in a width corresponding to 3 to 6 hanger tubes.

8. An insulated refractory shield according to claim 1 additionally comprising a rigid upper course insulation unit between said refractory shield and said hanger tube directly below each said shelf metallic hanger means, said upper course insulation unit having a height of about one course of said refractory bricks and having an oblong cutout along a bottom edge to accommodate said metallic hanger means and allowing said cooling fluid to flow from said hollow hanger tube oblong openings over said metallic hanger means.

9. An insulated refractory shield according to claim 8 wherein said rigid insulation units comprise a ceramic fiberboard material.

10. An insulated refractory shield according to claim 9 wherein said rigid insulation units are from about ½ inch to about 2 inches thick.

11. An insulated refractory shield according to claim 10 wherein said rigid insulation units are about 1 inch thick.

12. An insulated refractory shield according to claim 1 wherein said support clip comprises a low carbon steel material.

13. An insulated refractory shield according to claim 12 wherein said support clip comprises 20 to 24 gauge sheet steel.

* * * * *